US011352232B2

(12) United States Patent
Schilling et al.

(10) Patent No.: US 11,352,232 B2
(45) Date of Patent: Jun. 7, 2022

(54) APPARATUS AND METHOD FOR POSITIONALLY DEFINED TRANSPORT OF SHEETS

(71) Applicant: BW Papersystems Stuttgart GmbH, Nürtingen (DE)

(72) Inventors: Andreas Schilling, Lichtenstein (DE); Hansjörg Klein, Aichwald (DE)

(73) Assignee: BW Papersystems Stuttgart GmbH, Nürtingen (DE)

( * ) Notice: Subject to any disclaimer, the term of this patent is extended or adjusted under 35 U.S.C. 154(b) by 10 days.

(21) Appl. No.: 16/621,526

(22) PCT Filed: Jun. 14, 2018

(86) PCT No.: PCT/EP2018/065834
§ 371 (c)(1),
(2) Date: Dec. 11, 2019

(87) PCT Pub. No.: WO2018/229205
PCT Pub. Date: Dec. 20, 2018

(65) Prior Publication Data

US 2020/0165094 A1 May 28, 2020

(30) Foreign Application Priority Data

Jun. 14, 2017 (DE) ..... 10 2017 005 661.7
Feb. 16, 2018 (DE) ..... 10 2018 103 563.2
Feb. 19, 2018 (DE) ..... 10 2018 103 597.7

(51) Int. Cl.
*B65H 29/68* (2006.01)
*B65H 29/66* (2006.01)
(Continued)

(52) U.S. Cl.
CPC ..... *B65H 29/686* (2013.01); *B65H 29/6654* (2013.01); *B26D 2007/322* (2013.01);
(Continued)

(58) Field of Classification Search
CPC .... B65H 5/24; B65H 29/686; B65H 29/6654; B65H 29/242; B65H 29/6618;
(Continued)

(56) References Cited

U.S. PATENT DOCUMENTS 5,160,132 A * 11/1992 Hanada ..... B65H 29/16 271/183
5,275,394 A 1/1994 Mank et al.
(Continued)

FOREIGN PATENT DOCUMENTS

DE 3812685 A1 10/1989
DE 9103137 U1 6/1991
(Continued)

OTHER PUBLICATIONS

International Search Report issued in corresponding International Application No. PCT/EP2018/065834, dated Oct. 1, 2018.

*Primary Examiner* — Patrick Cicchino
(74) *Attorney, Agent, or Firm* — Andrus Intellectual Property Law, LLP

(57) ABSTRACT

The invention relates to an apparatus, in particular a roll cross cutter, for forming a shingled stream of underlapping or overlapping sheets, in particular paper or cardboard sheets, comprising a transport device for transporting sheets, a shingling device for underlapping or overlapping of the sheets at least in some regions, a braking device following the shingling device in the transport direction of the sheets for braking of shingled sheets, in particular by the formation of a brake gap for the passage of sheets brought together in a shingled manner, and a cross-cutting device upstream of the shingling device for cutting a material strip into individual sheets. According to the invention, an intake section is provided between the shingling device and the braking
(Continued)

device for intake and further transport of a sheet, trailing in the shingled stream, into the braking device.

21 Claims, 2 Drawing Sheets

(51) Int. Cl.
*B65H 5/24* (2006.01)
*B65H 29/24* (2006.01)
*B26D 7/32* (2006.01)

(52) U.S. Cl.
CPC ..... *B65H 5/24* (2013.01); *B65H 29/242* (2013.01); *B65H 29/6618* (2013.01); *B65H 29/68* (2013.01); *B65H 2301/44732* (2013.01); *B65H 2511/11* (2013.01); *B65H 2511/22* (2013.01); *B65H 2701/176* (2013.01)

(58) Field of Classification Search
CPC ..... B65H 29/68; B65H 2701/176; B65H 2511/11; B65H 2511/22; B65H 2301/44732
See application file for complete search history.

(56) References Cited

U.S. PATENT DOCUMENTS

| | | | | |
|---|---|---|---|---|
| 7,942,406 | B2 * | 5/2011 | Ootaki | B65H 29/6654 271/197 |
| 8,152,168 | B2 * | 4/2012 | Rossfeldt | B65H 29/686 271/270 |
| 10,843,887 | B2 * | 11/2020 | Nitschko | B65H 29/245 |
| 2008/0264279 | A1 * | 10/2008 | Shimizu | B65H 29/242 101/227 |
| 2015/0069696 | A1 | 3/2015 | Schilling et al. | |
| 2016/0023859 | A1 | 1/2016 | Klein | |

FOREIGN PATENT DOCUMENTS

| | | | | |
|---|---|---|---|---|
| DE | 10103040 | A1 | 11/2001 | |
| EP | 0503530 | A1 * | 9/1992 | B65H 29/6618 |
| JP | H0578000 | A | 3/1993 | |
| JP | 2000296960 | A | 10/2000 | |
| JP | 2004043106 | A | 2/2004 | |
| JP | 2015514651 | A | 5/2015 | |
| JP | 2015524781 | A | 8/2015 | |

* cited by examiner

APPARATUS AND METHOD FOR POSITIONALLY DEFINED TRANSPORT OF SHEETS

CROSS-REFERENCE TO RELATED APPLICATIONS

This application is the U.S. national stage application of International Application PCT/EP2018/065834, filed Jun. 14, 2018, which International Application was published on Dec. 20, 2018, as International Publication WO 2018/229205 in the German language. The International Application claims priority to German Application No. 102017005661.7, filed Jun. 14, 2017, German Application No. 102018103563.2, filed Feb. 16, 2018, and German Application No. 102018103597.7, filed Feb. 19, 2018. The International Application and German Applications are all incorporated herein by reference, in their entireties.

FIELD

The invention relates to an apparatus, in particular a so-called roll-type cross-cutter, for forming a shingled stream of underlapping or overlapping sheets, in particular paper or cardboard sheets, having a transport device for transporting sheets, having a shingling device for underlapping or overlapping the sheets in regions, having a braking device which is situated downstream of the shingling device in a transport direction of the sheets and which serves for braking shingled sheets, in particular by forming a braking gap for the passage of sheets that have been brought together in shingled form, and having a cross-cutting device which is positioned upstream of the shingling device and which serves for cutting a material strip into individual sheets. The invention furthermore relates to a method for forming a shingled stream of underlapping or overlapping sheets, in particular foils or paper or cardboard sheets, furthermore in particular for forming a shingled stream of individual sheets cut from a material strip by means of a cross-cutter, wherein separated sheets are transported to a shingling device and are underlapped or overlapped in regions in order to generate a shingled stream, and wherein the shingled sheets are braked by means of a braking device which is situated downstream of the shingling device in a transport direction of the sheets.

BACKGROUND

A roll-type cross-cutter is known, for example, from DE 101 03 040 A1. With the known roll-type cross-cutter, paper or cardboard sheets can be provided as a virtually endless strip in the form of a paper roll. By means of a feed device with rolls or drums, the strip is fed to a cross-cutting device and is cut there into sheets with a defined length. A paper store is frequently positioned upstream of the feed device in order to maintain a certain web length of the paper. The cut sheets are fed with the aid of fast-running transport belts to a shingling device for forming an underlapping configuration of the sheets. The shingling device comprises a raising shaft and, arranged above the latter, a suction belt. The sheets running through the shingling device are, at a defined point of the sheets, in particular in relation to the rear edge of the sheets, raised relative to the transport plane by the raising shaft and pressed against the suction belt arranged thereabove. The suction belt revolves at a lower speed than the fast-running transport belts that transport the sheets onward from the cross-cutting device. The sheet is therefore braked when the rear edge of the sheet is pressed by the raising shaft the suction belt arranged thereabove and is held by the latter. The shingling device acts here as a first, rear braking unit.

A braking device as a second, front braking unit is positioned downstream of the shingling device in the transport direction of the shingled stream. Such a braking device is described, for example, in DE 38 12 685 A1. The braking device can have at least one so-called nip roll which, together with a transport belt, a further roll or a drum, forms a braking gap. The spacing between the braking device and the shingling device is set such that the sheet front edge of a sheet preferably runs straight into the braking gap of the braking device and is decelerated, just as the rear sheet region, in particular the rear edge of the sheet, is pressed by the raising shaft of the shingling device against the suction belt. In this way, the sheet is preferably simultaneously braked or decelerated by the nip roll in the front sheet region and by the suction belt of the shingling device in the rear sheet region. By means of the simultaneous braking of the sheet in the region of its front edge and rear edge, a formation of a wave in the sheet during the braking process is prevented. The trailing sheet moves at a higher speed than the leading sheet which has already been upturned. Since the leading sheet is held up by its rear edge on the suction belt, the front edge of the trailing sheet can be conveyed under the leading sheet. The difference in speed between the leading and trailing sheet thus results in an underlapping configuration of the sheets. A continuous shingled stream is thereby produced. Following the braking device, the shingled stream formed by the underlapped sheets is transported onward, with the same speed and the same shingling length of the underlapped sheets, onto a transfer table with slow-running transport belts to a further-processing machine.

As described in the preceding paragraph, the sheets are braked approximately simultaneously at their front and rear edges. In particular in the case of long sheet formats, sagging of the sheets may occur, wherein a sagging leading sheet may impede a following sheet in its forward movement. This can lead to problems in the positioning accuracy of the trailing sheets at the braking gap. In order to prevent sagging of the sheets, in the case of the above-described underlapping configuration, the sheets after being pushed up by the beater shaft, are pulled by the suction belt, held and, furthermore, tightened or tensioned.

Tensioning of the sheets is realized by virtue of the speed of the suction belt being set to be somewhat lower than the speed of the nip rolls of the braking device. Owing to the tensile forces that are exerted on the sheet by the speed difference between the nip rolls and the suction belt, the sheet is tensioned, and the sagging is reduced. When the leading sheet is conveyed out of the engagement region of the suction belt, said sheet is no longer held by the suction belt. A sheet dropping down would impede the front edge of the trailing sheet in such a manner that a positionally defined undershingling configuration would no longer be possible. Due to the greater friction, caused by the dead weight of the leading sheet, the more fast-running trailing sheet would be impeded in its forward movement. For this reason, a sheet which is upturned at its rear edge remains longer than one cycle in the region of action of the suction belt. A cycle refers to the period of time between the upturning of a first, leading sheet and the upturning of a second, trailing sheet. It is therefore ensured that the leading sheet, when it leaves the region of influence of the suction belt, continues to be held up by a trailing, upturned and already sucked-up sheet since the rear edge of the trailing sheet is then already located in the region of action of the suction belt and the trailing sheet holds up the leading sheet. The suction belt accordingly has to apply a sufficiently high suction power in order to be able to securely hold both the upturned sheets and also the sheets held by the upturned sheets.

An increasing sheet length causes an increase in the weight of the leading sheet, which must be borne by the trailing sheet. Therefore, in the case of large sheet formats, the risk of sagging of the sheets increases. Furthermore, despite the difference in speed between the slow-running transport belts and the suction belt of the shingling device, the suction belt guiding the rear edges of the sheets, it is not possible to completely prevent sagging of the sheets. For this reason, in particular in the case of long sheet formats, greater sagging of the leading sheets occurs, as a result of which a braking action on the front edge of the trailing sheet may be produced due to frictional contact. This has a negative effect on the positioning and position of the trailing sheet. A sheet which has slipped or does not lie optimally in the shingled stream may lead to position errors leading to damage to the sheet, but even to stoppage of the entire apparatus.

SUMMARY

It is an object of the present invention to provide an apparatus and a method of the respective type mentioned in the introduction which permit an exact or defined inflow of a trailing sheet in the sheet stream into the braking device. Furthermore, it is the intention, even at high transport speeds, to reliably avoid damage due to the sheets not running exactly into the braking device.

The above-stated object is achieved according to the invention, in the case of an apparatus of the type mentioned in the introduction, in that the region between the shingling device and the braking device is provided with a suction intake section which is preferably formed below the transport plane of the sheets and which serves for onward transport of the sheet front edge of a trailing sheet in the shingled stream into the braking device. Accordingly, in the method according to the invention, it is provided that the trailing sheets of a shingled stream are transported preferably from below into the braking device under the action of a suction intake.

The invention is based on the underlying concept of feeding the front edges of the following sheets in a defined manner to the braking device by means of a suction intake in the region between the shingling device and the braking device. The sheet front edge of a trailing sheet is moved onward here at least in sections relative to a leading sheet, wherein, in the case of an undershingling configuration, the sheet front edge is sucked up from below and is located below a leading sheet. In the case of an overshingling configuration, the sheet front edge of a trailing sheet is sucked up from above and is then located above the leading sheet. The positioning accuracy of the front edge and therefore of the entire sheet is thereby significantly increased. With the aid of the invention, it is also possible to prevent damage to the sheet at the braking point, which damage may arise due to position inaccuracies of the front edge.

The suction intake section is formed, for example, in the case of the undershingling configuration, by generation of a negative pressure below the transport plane of the sheets. It goes without saying that the solution according to the invention can also be realized with appropriate adaptation in conjunction with the overshingling of the sheets.

In order to form a suction intake section, at least one suction intake device is provided. For example, the suction intake device can interact with at least one suction belt which is moved in the transport direction and serves for onward transport of the sheets after passing through the shingling device. The negative pressure generated by the suction intake device is formed in such a manner that at least the front edge or a region of the front edge of a sheet is secured such that the sheet is transported accurately in a desired position.

The suction intake section is preferably formed by a plurality of suction belts which are arranged one behind another transversely with respect to the transport direction and run parallel to one another. The suction belts are used to suck up and transport the sheets. Each of the suction belts can be assigned a dedicated suction intake device. However, it is also possible for merely a single suction intake device, for example a suction box, to be provided, via which a negative pressure is generated for all of the suction belts. Alternatively, it is also possible for the suction intake section to be formed by a plurality of transport belts which are arranged one behind another transversely with respect to the transport direction and run parallel to one another, wherein then no negative pressure is generated via the transport belts. In this embodiment, suction intake zones lying between the transport belts can be formed in order to generate the negative pressure. The suction intake device is then designed to generate a negative pressure in the region of the suction intake zones, the negative pressure acting on the sheets and drawing the latter against the transport belts during the sheet transport by means of the transport belts.

A sheet which passes with its front edge into the region of the suction intake section is pulled at least in the region of the sheet front edge and therefore transported in a defined position in the transport direction of the sheets. The front edge of the sheet is fixed here on at least one suction belt or transport belt in such a manner that the front edge of the sheet is not released during the transport. For this reason, the sheet front edge can be transported without damage into a braking gap of the braking device. In the case of the undershingling configuration, the rear edge of the sheet in the shingling device, just as the sheet front edge enters the braking device, can be pushed by a beater shaft of the shingling device against a suction belt, arranged thereabove, of the shingling device. The rear edge of the sheet is then held up by the suction belt of the shingling device and braked simultaneously in the region of the sheet front edge and the sheet rear edge. The trailing sheet can continue to be located on the fast-running transport device, wherein at least the region of its front edge enters the region of the suction intake section. The trailing sheet is conveyed here at a higher speed relative to the leading sheet, with a defined position in the transport direction of the sheets, below the leading sheet to the braking device. Detaching of the front edge of the sheet from the suction intake section is therefore prevented. The trailing sheet can therefore be conveyed without impairment and without collision with the leading sheet below the leading sheet to the braking device. An undershingling configuration of the sheet stream is thereby achieved. A person skilled in the art knows that, in a different arrangement, an overshingling configuration of the sheet stream can also be achieved. The invention therefore refers explicitly both to an undershingling configuration and to an overshingling configuration of the sheet stream.

A further suction intake section is preferably provided between the cross-cutter and the shingling device. The suction intake section between the shingling device and the braking device and the further suction intake section can be formed with the same suction intake device or with a plurality of separate suction intake devices. The further suction intake section serves to transport the sheets in a defined manner in a desired position from the cross-cutter to the shingling device. High positioning accuracy of the sheets is thereby achieved, which is necessary since both the cross-cutter and the shingling device have to operate in the same cycle as the further-processing machine. Owing to said cycling, it is important for the sheet front edge at any point in time to take up a position defined with respect to the point in time. The position accuracy refers of course to the entire sheet.

It can furthermore be provided that the suction intake section between the shingling device and the braking device and the further suction intake section in the region of the shingling device are interrupted. Between the suction intake section between the shingling device and the braking device and the further suction intake section there is then a region in the transport plane of the sheets, in which no negative pressure or a significantly lesser negative pressure is generated. This is in particular of advantage when the sheet rear edge is turned up by means of the beater shaft. The turning up of the rear edge of a sheet is thereby facilitated since, during the turning-up process, a significantly reduced suction force, if any at all, acts on the rear edge of the sheet. The suction intake section is designed here in such a manner that the sheet is sucked up at least in the region of the front edge and is conveyed in a defined position in the transport direction during and after the sheet rear edge is grasped by the beater shaft and pushed onto the suction belt, lying thereabove, of the shingling device. Since, in the region of the beater shaft of the shingling device, a significantly reduced suction force, if any at all, acts on the sheet, the loadings which a sheet experiences during the turning-up process are reduced. A high suction action on the rear edge of a sheet during the turning-up process could lead to the sheet being damaged during the turning-up process or slipping out of its defined position.

In an advantageous manner, the pressure level in the region of the suction intake section between the shingling device of the braking device is reduced less severely than in the region of the further suction intake section between cross-cutter and shingling device. Less severely means in this connection that the pressure difference between the negative pressure generated at the suction intake section between the shingling device and the braking device and the ambient pressure is formed less severely than in the region of the further suction intake section. This leads to the sheet being pulled with a high force in the region between the cross-cutter and the shingling device in order to achieve high positional accuracy. In the region of the suction intake section between the shingling device and the braking device, the sheet, or at least the front edge of the sheet, is pulled less severely. The different negative pressure levels on both sides of the shingling device permit an exact and rapid sheet transport from the cross-cutter to the braking device.

It can be expedient if, in the region of the suction intake section between the shingling device and the braking device, a reduction in pressure in relation to the ambient pressure of less than 2 mbar, preferably of less than 1 mbar, furthermore preferably of less than 0.5 mbar, particularly preferably of less than 0.1 mbar, takes place. However, the reduction in pressure can also be significantly higher and a reduction in pressure in relation to the ambient pressure of 0.5 to 10 mbar, preferably of between 1 to 5 mbar, in particular of up to 2 mbar, can be provided. The effect advantageously achieved by a reduction in pressure is that the sheet front edge and therefore the entire sheet can be transported in a defined position.

In a further advantageous manner, a ten times to one hundred times greater reduction in pressure takes place in the region of the further suction intake section, i.e. in the region between cross-cutter and shingling device, than in the region between the shingling device and the braking device. By means of the greater negative pressure, the sheets are transported in a precise position from the cross-cutter to the shingling device.

In an advantageous embodiment, the shingling device is designed to be adjustable in and/or counter to the transport direction of the sheets in a manner dependent on a cut length. This permits simple adaptation of the apparatus to a changed sheet format. The term "dependent on a cut length" refers to a change in the arrangement of the shingling device relative to the cross-cutter and, preferably, relative to the braking device, for a format change of the sheet. In a further advantageous embodiment, the braking device is designed to be non-adjustable in and/or counter to the transport direction of the sheets. The spacing between the transfer point and the braking device is therefore the same for each sheet format, i.e. is independent of a cut length.

The shingling device can then be moved, offset or displaced relative to the braking device in or counter to the transport direction of the sheets, depending on the current (new) sheet length, and therefore, for every sheet length which can be set, a leading sheet is braked approximately simultaneously at the front by the braking device and at the rear by the shingling device. In particular, it is possible to keep the spacing between the transfer point and the braking device or the transfer length constant in the event of a format change, wherein the braking device in the event of a format change is preferably not adjusted. Instead, the spacing between the braking device, which is preferably arranged at a fixed position, and the shingling device is adapted to the actual sheet length by adjustment of the shingling device. The spacing between the front transfer point of the sheets to a sheet-processing machine and the braking device or the transfer length for different formats or cut lengths thus remains the same, which leads to a considerable simplification when setting the apparatus to a different sheet format. In particular, with the transfer length remaining the same, it is unnecessary to change the overlapping length of the sheets in the shingled stream in the event of a format change.

Furthermore, a defined stopping point of the apparatus which is identical for each sheet format can be defined. The degree of shingling or the overlapping length can be kept the same for each sheet format when there is a fixed spacing between the transfer point and the braking device. The length between the transfer point and the braking device corresponds precisely to an integral multiple of the shingling length. In the event of a stoppage, the leading sheet is always located in the region of influence of the suction belt, as a result of which it is possible for the trailing sheet to be pushed under the leading sheet. In the event of a system stoppage, a trailing sheet can be transported onward under the leading sheet. As a result, it is possible to have to brake the fast-running belts less severely or less rapidly than the slow-running belts since the overlapping length acts as a buffer for the trailing sheet. The material stressing of the fast-running belts and of the braking units thereof can thereby be significantly reduced. Since the risk of an uncontrolled slipping of a sheet is minimized because of the reduced braking, the braking of the sheets has to be less strongly assisted. The energy demand in the event of a system stoppage can thereby be further reduced. When the apparatus starts up again, the slow-running belts can be driven in terms of time shortly before the fast-running belts, as a result of which the correct phase position is restored in the apparatus. In this context, phase position means that the relative position of the sheets with respect to the beater shaft and the position of the blades on the cross-cutting device always take up a fixed position relative to each other. A system start is therefore possible in a simple manner and within a short time.

It is furthermore possible to prevent a stoppage of the apparatus while the cross-cutting device is currently in the cutting position. A stoppage of the apparatus while the cross-cutting device is currently carrying out the cut can lead to uncontrolled damage of the sheet and/or of the material web. In this respect, a stoppage of the apparatus in the cutting position must be avoided. Since the trailing sheet has the shingling length or the overlapping length as a buffer in relation to the leading sheet which has already been turned up, the slow-running transport belts and the cross-cutting device can be stopped specifically in such a manner that the cross-cutting device stops outside the cutting position.

The transport device advantageously has at least one suction belt, in particular a belt arrangement having a plurality of suction belts running parallel to one another, wherein the suction belt is guided continuously in the transport direction of the sheets from the cross-cutter to the braking device, i.e. over the two suction intake sections and the region of the shingling device. Therefore, just one preferably fast-running suction belt or just one belt arrangement extends over the two suction intake sections and the region of the shingling device. By this means, an easy and simple control is achieved. A synchronization of belt sections arranged one after another in the transport direction is therefore unnecessary. Alternatively, however, belt sections which are separated from one another can also be provided in order to permit the sheet transport in the region of the two suction intake sections.

At least one suction intake device is advantageously provided for forming a suction intake section, wherein the suction intake device has a suction profile or a suction box. The use of a suction profile or of a suction box makes it possible to generate the generated negative pressure in a targeted and locally limited manner. In an advantageous manner, a continuous suction profile is provided, in particular an arrangement of a plurality of suction profiles lying one behind another transversely with respect to the transport direction of the sheets, or a continuous suction box is provided for reducing the pressure and forming the suction intake section between the shingling device and the braking device and for forming the further suction intake section. A continuous suction profile from the cross-cutter to the braking device in a simple manner permits simple sealing and adaptation of the generation of negative pressure over the profile length in the transport direction of the sheets.

In a preferred embodiment, a non-continuous decrease in the reduction in pressure or an abrupt drop in pressure is provided over the length of the suction profile or suction box in the region of the shingling device. This means that the negative pressure in the suction profile increases in the region of the overlapping device from a lower negative pressure in the transport direction of the sheets upstream of the shingling device to a less low negative pressure downstream of the shingling device. For this purpose, a single interruption-free suction profile or a single, interruption-free or continuous suction box can be provided, wherein the negative pressure level in the suction profile or suction box is divided by a lock or seal. In other words, the length of the suction intake sections can be changed by a change in the position of the lock. The lock or the seal causes a non-continuous change in the reduction in pressure over the length of the suction profile or suction box. The position of the abrupt increase in pressure in the suction profile or suction box in the transport direction of the sheets can be changed in a simple manner by the movable lock and, in particular when the shingling device is designed to be adjustable depending on the sheet format, can be aligned with the position of the shingling device.

In a further preferred embodiment of the invention, the movable lock or seal is designed to be adjustable together with the shingling device in and/or counter to the transport direction of the sheets. The common adjustability can be achieved in that a common carriage for the shingling device and the movable seal or lock is provided, wherein the common carriage is designed to be adjustable in and/or counter to the transport direction of the sheets. The position of the non-continuous change in pressure migrates with the position of the shingling device in or counter to the transport direction of the sheets during the adjustment of the shingling device. It is therefore ensured that a less low pressure level is consistently always present at the location of the shingling device than in the region between cross-cutter and shingling device.

Alternatively, in order to form a length-changeable suction intake section between the shingling device and the braking device, at least one telescopic suction profile and/or at least two intermeshing suction profiles can be provided. Telescopic and/or meshing suction profiles are simple mechanical configurations of length-changeable suction intake apparatuses. Telescopic means in this case that a plurality of suction profiles of complementary design can be displaced in one another and therefore the length of the entire suction profile can be changed. It has to be ensured here that the two complementary, intermeshing suction profiles are connected tightly to each other, for example with the aid of a dynamic seal, such that a substantially identical pressure profile can be achieved over the length of the suction profile.

The suction intake section can also be formed from suction profiles arranged in an alternating manner, wherein a first suction profile originates in the transport direction from the shingling device and a second suction profile originates counter to the transport direction from the braking device and the two suction profiles overlap at least in sections transversely with respect to the transport direction. The two suction profiles can be displaced counter to each other in a meshing manner until the front edge of the one suction profile reaches the rear edge of the other suction profile, and vice versa. The maximum length of the suction intake section is then reached.

The two above-mentioned possibilities for forming a length-changeable suction intake section between the shingling device and the braking device also permit an adjustable arrangement of the braking device relative to the shingling device. If the braking device is intended to be adjusted in and/or counter to the transport direction of the sheets, for example in order to adapt the apparatus to a changed sheet format, the suction intake section between the shingling device and the braking device can be adapted in a simple manner to the changed length between the shingling device and the braking device.

The previously described embodiments of the invention may be combined with one another as required. The content of disclosure of the invention is not restricted to the combinations of features of the invention predetermined by the selected paragraph formatting.

Further features of the present invention will emerge from the following description of an exemplary embodiment of the invention on the basis of the drawings, and from the drawings themselves. All of the features described and/or illustrated in the figures here form the subject matter of the present invention individually or in any desired combination, irrespective of their combination in the claims or the dependency references thereof.

BRIEF DESCRIPTION OF THE DRAWINGS

The invention will be explained in more detail below with reference to the figures, in which.

DETAILED DESCRIPTION

Figure 1:
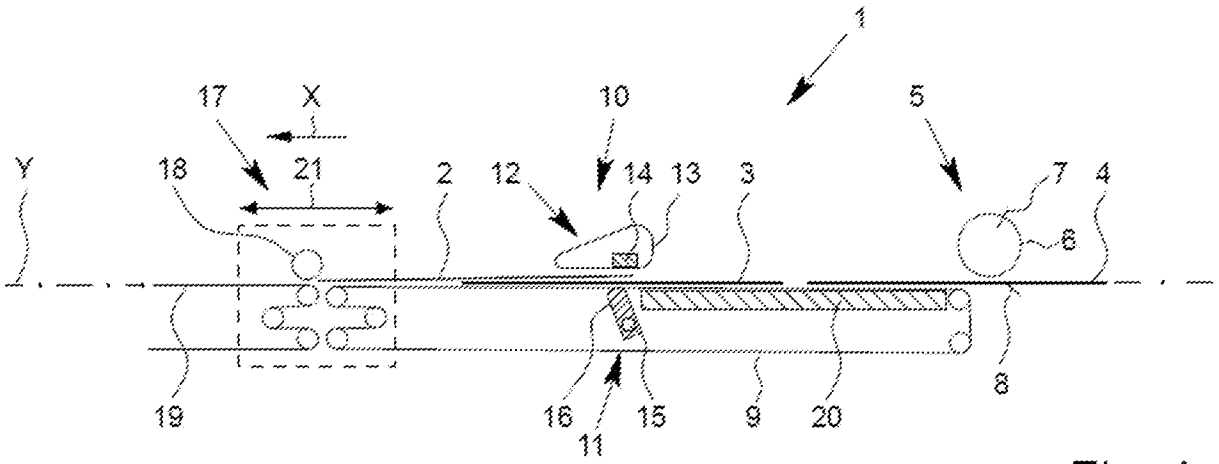
FIG. 1 shows a schematic illustration of an apparatus for forming a shingled stream of underlapping sheets according to the prior art in a side view.

FIG. 1 schematically shows an apparatus 1 known from the prior art for forming a sheet stream 2 of underlapping sheets 3 of paper, foil or cardboard. The apparatus 1 has a feed device (not illustrated) which conveys a virtually endless paper or cardboard strip 4. The strip is provided from a paper or paperboard roll on a feed side by means of an unrolling device (not illustrated) and can be guided through a paper store connected in between. A cross-cutting device 5 positioned downstream of the feed device (not illustrated) in a transport direction X of the sheets 3 cuts the strip 4 into sheets 3 of a defined length. The cross-cutting device 5 is designed in the form of a rotatably mounted shaft 6 which, on its circumference, has a cutting edge 7. If the cutting edge 7 arranged on the shaft 6 and a fixed cutting edge 8 are in engagement, the strip 4 is cut. The sheet length can be set by changing the rotational speed of the shaft 6 and by the feed speed.

The sheets 3 are transported onward in the transport direction X on a belt section with at least one fast-running transport belt 9. A belt section having a plurality of transport belts 9 is preferably provided, the transport belts lying one behind another and being spaced apart from one another transversely with respect to the transport direction X. The following explanations with regard to the transport belt 9 refer to said belt section.

A shingling device 10 situated downstream of the cross-cutting device 5 consists of a raising unit 11 and a decelerating unit 12. The decelerating unit 12 has at least one suction belt 13 arranged above the transport plane Y of the sheets 3. The suction belt 13 is formed by a transport belt which is provided with holes and which interacts with a vacuum-generating suction box 14. The raising unit 11 has a beater shaft 15 with at least one beater 16. The beater 16 of the raising unit 11, during each revolution of the beater shaft 15, presses a sheet 3 against the suction belt 13. Since the suction belt 13 is moved at a lower speed than the fast-running transport belt 9, the front edge of a trailing sheet 3 is conveyed under the raised rear edge of a leading sheet 3. With the next revolution of the beater shaft 16, the trailing sheet 3 is raised at the rear edge such that the next trailing sheet 3 can be conveyed under the trailing sheet 3. In this way, a sheet stream 2 of underlapping sheets 3 is generated. When the rear edge of the leading sheet 3 is no longer situated in the engagement region of the suction belt 13, the leading sheet 3 is held above the transport plane by the trailing sheet 3 since the trailing sheet 3 is already held up by the suction belt 13 before the leading sheet 3 leaves the engagement region of the suction belt 13.

A braking device 17 is provided downstream of the shingling device 10 in the transport direction X of the sheet stream 2. The braking device 17 has at least one nip roll 18 which, together with at least one slow-running transport belt 19, forms a braking gap. The spacing between the braking device 17 and the shingling device 10 is set such that the sheet front edge of a sheet 3 preferably runs straight into the braking gap, and is decelerated, just as the rear sheet region, in particular the rear edge of the sheet 3, is pressed by the beater 16 of the raising unit 11 against the suction belt 13. The sheet 3 is thereby braked or decelerated preferably approximately simultaneously by the nip roll 18 and by the slow-running transport belt 19 in the front region and by the suction belt 13 in the rear sheet region. In order to tension the sheet and to reduce sagging of the sheet, the suction belt 13 has a slightly reduced speed in comparison to the slow-running transport belt 19. Following the braking device 17, the sheet stream 2 is transported onward at the same speed, and in particular with substantially the same shingling length, i.e. with a same spacing from the front edge of the leading sheet 3 to the front edge of the trailing sheet 3, on a transfer table (not illustrated) to a transfer point (not illustrated) of a further-processing machine.

In the region between the cross-cutting device 5 and the shingling device 10, a suction box 20 can be arranged below the transport belt 9. The transport belt 9 is then preferably designed as a suction belt. A negative pressure is generated in the suction box 20, as a result of which the sheets are pulled against the transport belt 9. By this means, the sheet 3 or the material web 4 is transported on the transport belt 9 before, during and after cutting in the cross-cutting device 5.

As can be seen in FIG. 1, the braking device 17 is designed to be adjustable in and/or counter to the transport direction X of the sheets 3. This is illustrated by the double arrow 21. If the apparatus 1 is changed to a different sheet format, the braking device 17 is adjusted in such a manner that the spacing between the braking device 17 and the shingling device 10 substantially corresponds to the sheet length of the new sheet format. The spacing between the braking device 17 and the shingling device 10 is intended to be set in such a manner that the sheet 3 is braked substantially simultaneously at its front edge by the braking device 17 and at its rear edge by the suction belt 13 of the shingling device 10.

The shingling device 10 can then be moved, offset or displaced relative to the braking device 17 in or counter to the transport direction of the sheets 3 depending on the current (new) sheet length, and therefore, for each sheet length which can be set, a leading sheet 3 is braked approximately simultaneously at the front by the braking device 17 and at the rear by the shingling device 10. In particular, it is made possible to keep the spacing between the transfer point and the braking device 17 or the transfer length in the event of a format change constant, wherein the braking device 17 is preferably not adjusted in the event of a format change. Instead, the spacing between the braking device 17, which is preferably arranged in a fixed position, and the shingling device 10 is adapted to the actual sheet length by adjustment of the shingling device 10. The spacing between the front transfer point of the sheets 3 to a sheet-processing machine and the braking device 17 or the transfer length thus remains the same for different formats or cut lengths, which leads to a considerable simplification in the setting of the apparatus to a different sheet format. In particular, when the transfer length remains the same, it is unnecessary to change the overlapping length of the sheets 3 in the shingled stream in the event of a format change.

It has been shown in the case of the apparatus 1 illustrated in FIG. 1 that the transport of the sheet front edge of the sheet 3 between the shingling device 10 and the braking device 17 is susceptible to faults. The front edge of the sheet 3, in particular at high transport speeds, may thus become detached from the fast-running transport belt 9. Detaching of the sheet front edge from the transport belt 9 may cause the sheet 3 to be damaged as it enters the braking gap of the braking device 17. Furthermore, detaching of the sheet front edge can cause the sheet 3 to be brought out of its position, and therefore, subsequently, an inexact shingling length is formed between the front edge of the leading sheet 3 and the front edge of the trailing sheet 3. Furthermore, during the detaching from the fast-running transport belt 9 or by means of slipping, the sheet front edge can enter into frictional contact with the leading sheet 3. The sheet 3 can thereby be additionally braked, and therefore the desired shingling length is likewise not reached.

Figure 2:
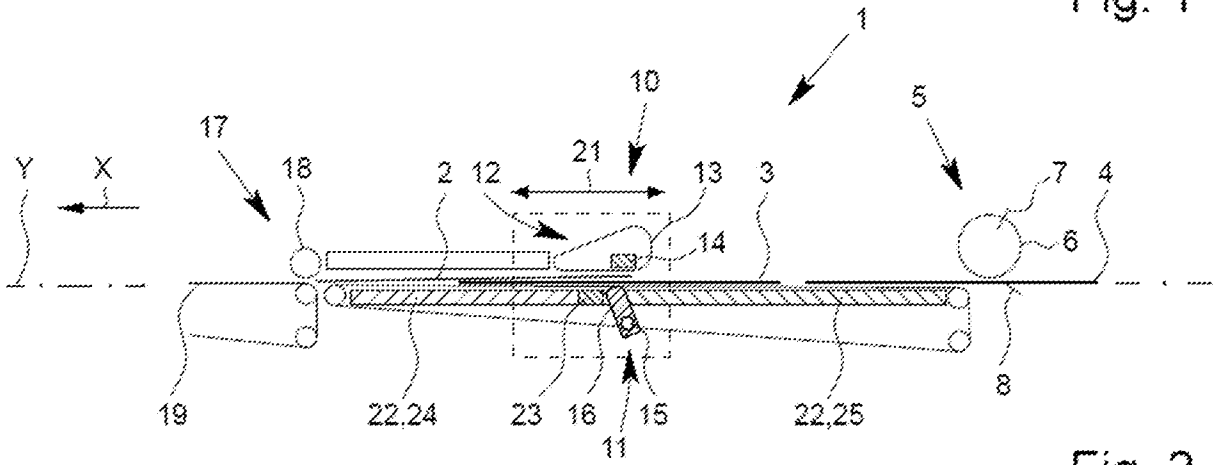
FIG. 2 shows a schematic illustration of an apparatus according to the invention for forming a shingled stream of underlapping sheets in the operating state in a side view.

FIG. 2 shows schematically another apparatus 1 for forming a shingled stream 2 of underlapping sheets 3 in a side view. Identical or corresponding functional units, assemblies, components and other corresponding features of the apparatus 1 shown in FIGS. 1 and 2 are provided with the same reference signs. The formation of a shingled stream 2 of underlapping sheets 3 from paper, foil or cardboard takes place, in the embodiment shown in FIG. 2, in a corresponding manner to the above-described formation of a shingled stream in the apparatus 1 from FIG. 1.

In a departure from the apparatus 1 shown in FIG. 1, in the embodiment according to FIG. 2 it is provided that the shingling device 10 is designed to be adjustable in and/or counter to the transport direction X depending on the sheet length or the sheet format. This is shown schematically in FIG. 2 by the double arrow 21. By contrast, the braking device 17 is designed to be non-adjustable in and/or counter to the transport direction X of the sheets 3. In other words, this means that the shingling device 10, when the cut length of the sheets 3 is changed or when there is a change in the sheet format, the shingling device 10 is offset, displaced or moved relative to the braking device 17 in such a manner that, for each sheet length set, a leading sheet 3 is braked approximately simultaneously at the front by the braking device 17 and at the rear by the deceleration unit 12 of the shingling device 10. The spacing between the transfer point (not illustrated) of the sheets 3 to a further-processing machine and the braking device 17 or the transfer length thus remains the same for different formats or cut lengths of the sheets 3, which leads to a considerable simplification in the setting of the apparatus 1 shown in FIG. 2 to a different sheet format. For a format change, the shingling device 10 can be adjusted in its entirety in or counter to the transport direction X of the sheet stream 2, i.e. the raising unit 11 and the deceleration unit 12 are moved together and, for this purpose, can be accommodated or mounted in an undercarriage or frame or carrier movable in and/or counter to the transport direction X of the sheets 3. In principle, it is, however, also possible for only the beater shaft 15 with the beater 16 to be adjusted in or counter to the transport direction X if the suction belt 13 extends sufficiently in the transport direction X.

In the apparatus 1 illustrated in FIG. 2, a suction profile 22 is provided between the shingling device 10 and the braking device 17 below the fast-running transport belt 9, said suction profile being designed as a hollow profile and being connected to a suction intake device (not illustrated), for example a suction blower. Preferably, in the case of a belt section having a plurality of transport belts 9 designed as suction belts, each transport belt 9 is assigned a suction profile 22.

Above a length portion of the suction profile 22 and the assigned portion of the transport belt 9, a first suction intake section 24 is formed between the shingling device 10 and the braking device 17, and a further suction intake section 25 is formed in the region between the shingling device 10 and the cross-cutting device 5. Via the suction profile 22 and the transport belt 9, a negative pressure acts on the sheets 3 at least in the region of the front edge of the sheets 3. The applied negative pressure prevents the front edge of a sheet 3 from being detached. At the same time, the formation of the suction intake section 24 causes the trailing sheet 3 to be transported onward in a defined position after passing through the shingling device 10. A defined under-shingling configuration of the sheets 3 is therefore possible without the sheets 3 obstructing one another. The suction profile 22 preferably extends over the entire length of the region between the cross-cutting device 5 and the braking device 17. In the region upstream of the shingling device 10, the further suction intake section 25 is formed by the suction profile 22.

The negative pressure present at the suction profile 22 is intended to be to be significantly less strong here in the region of the suction intake section 24 positioned downstream of the of the shingling device 10 in the transport direction X than the negative pressure present in the region of the further suction intake section 25 between the cross-cutting device 5 and the shingling device 10. In the region of the shingling device 10, more precisely in the region of the beater shaft 15 with the beater 16, a portion 23 is provided at which no negative pressure or a comparatively less strong negative pressure is present. The sheet 3 can thereby be raised in a simple manner in the region 23 and pressed against the suction belt 13. In the region of the sheet rear edge, the raising unit 11 therefore does not have to counteract a negative pressure which would hold the sheet 3 by its rear edge on the fast-running transport belt 9. A positionally precise transport of the trailing sheet 3 under the upturned leading sheet 3 is therefore possible while at the same time the sheet rear edge can be pressed by the beater 16 against the suction belt 13 without being impaired.

The suction profile 22 can preferably be formed by a continuous hollow profile. The different magnitudes of the vacuum in the region of the suction intake section 24 and the suction intake section 25 can be achieved by a lock or seal in the region of the shingling device 10. In this case, it is possible to provide just one device which generates negative pressure and is connected to the suction profile 22 in the region of the suction intake section 25. A low negative pressure is simultaneously generated in the suction intake section 24 via the lock. The reduction in pressure in the region of the suction intake section 24 in relation to the ambient pressure is preferably significantly smaller than the reduction in pressure in the region of the suction intake section 25.

It is advantageous if the lock in the profile that forms the suction intake sections 24, 25 is designed to be movable, in particular displaceable, in and/or counter to the transport direction X of the sheets 3. The length of the suction intake section 24 can therefore be adapted in a simple manner to the sheet format by adjustment of the lock. At the same time, the length of the suction intake section 25 is also changed, and therefore the sheets 3 are transported in a defined position and appropriately in terms of position from the cross-cutting device 5 to the shingling device 10.

It is particularly advantageous if the movable lock is designed to be adjustable together with the raising unit 11 and/or the entire shingling device 10 in and/or counter to the transport direction X of the sheets 3. For this purpose, a carriage, a framework or a frame (not illustrated) can be provided in which the shingling device 10 and the movable lock are arranged, wherein the carriage can be moved in and/or counter to the transport direction X of the sheets 3. The apparatus 1 can therefore be set in a simple manner to a new or changed sheet format.

If the suction belt 13 of the shingling device 10 extends over a sufficiently long section in the transport direction X of the sheets, it can also be provided that only the raising unit 11 and the movable lock are adjusted together in and/or counter to the transport direction X of the sheets 3.

Figure 3:
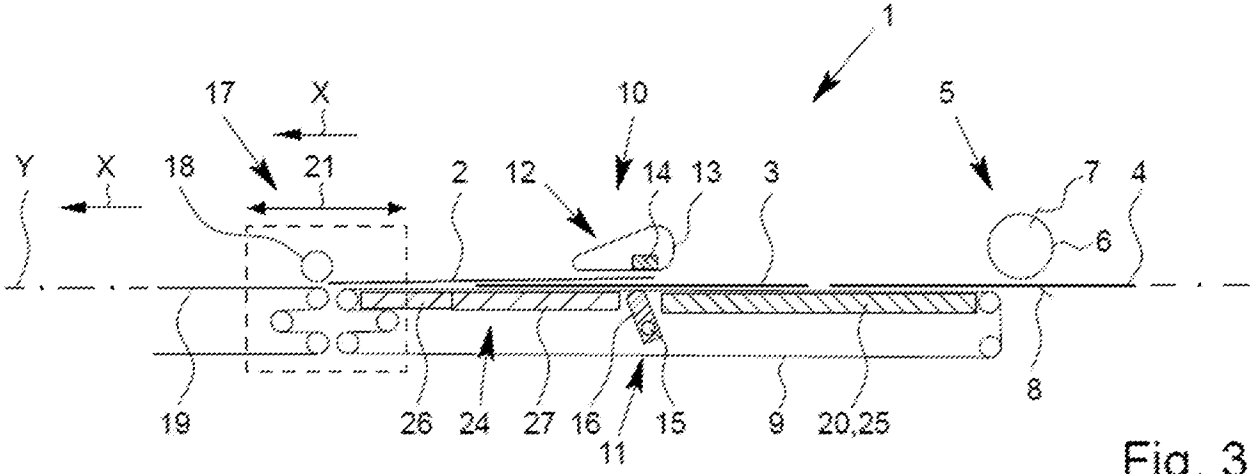
FIG. 3 shows a schematic illustration of a further embodiment of an apparatus according to the invention for forming a shingled stream of underlapping sheets in the operating state in a side view.

FIG. 3 schematically shows another apparatus 1 for forming a shingled stream 2 of underlapping sheets 3 in a side view. Identical or corresponding functional units, assemblies, components and other corresponding features of the apparatus 1 shown in FIGS. 1, 2 and 3 are provided with the same reference signs. The formation of a shingled stream 2 of underlapping sheets 3 of paper, foil or cardboard takes place, in the case of the embodiment shown in FIG. 3, in a manner corresponding to the above-described formation of the shingled stream in the apparatus 1 from FIG. 1.

In a departure from the apparatus 1 from FIG. 2, the braking device 17 is designed to be displaceable or adjustable in and/or counter to the transport direction X of the sheets 3 in accordance with the double arrow 21 in order to be able to adapt the apparatus 1 to a changed sheet format. The shingling device 10 in the apparatus 1 shown in FIG. 3 is fixed in position and is therefore not adjustable in and/or counter to the transport direction X of the sheets 3.

The suction intake section 24 is formed according to FIG. 3 by at least one telescopic suction profile which consists of suction profile portions 26 and 27 which can be pushed into one another, and is connected to a suction intake device. The suction profile portion 27 is preferably arranged in a fixed position and the suction profile portion 26 is preferably designed to be displaceable in and/or counter to the transport direction X of the sheets 3. The length of the suction intake section 24 can thus likewise be adapted to the sheet format.

Figure 4:
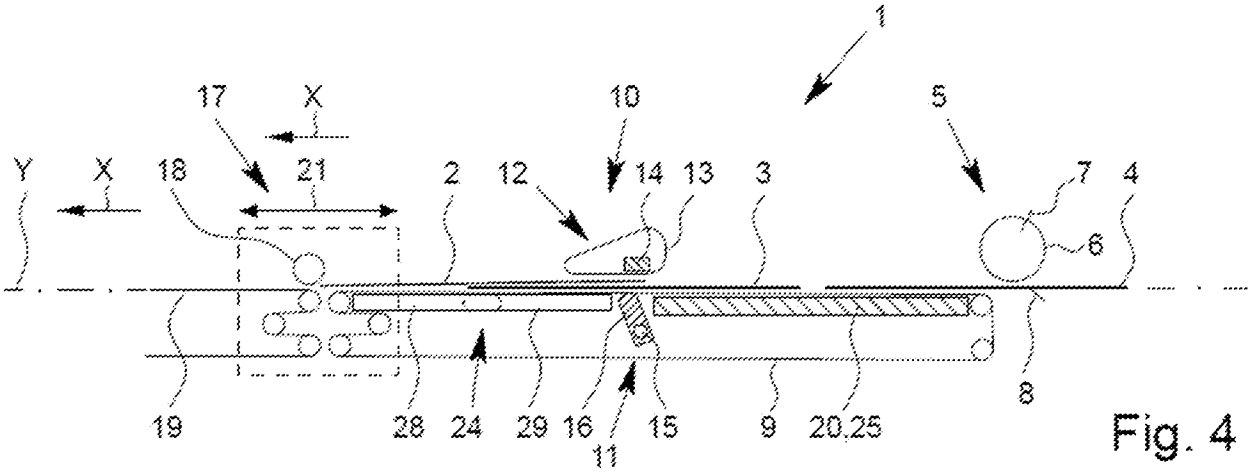
FIG. 4 shows a schematic illustration of a further embodiment of an apparatus according to the invention for forming a shingled stream of underlapping sheets in the operating state in a side view.

FIG. 4 shows schematically a further apparatus 1 for forming a shingled stream 2 of underlapping sheets 3 in a side view. Identical or corresponding functional units, assemblies, components and other corresponding features of the apparatus 1 shown in FIGS. 1, 2, 3 and 4 are provided with the same reference signs. The formation of a shingled stream 2 of underlapping sheets 3 of paper, foil or cardboard takes place, in the case of the embodiment shown in FIG. 2, in a manner corresponding to the above-described formation of a shingled stream in the apparatus 1 from FIG. 1.

The embodiment of the apparatus 1 shown in FIG. 4 differs from the embodiment of the apparatus 1 shown in FIG. 3 to the effect that the suction intake section 24 is formed from at least 2 intermeshing suction profiles 28 and 29 which can overlap at least in sections transversely with respect to the transport direction X of the sheets 3. The suction profiles 28, 29 are connected in turn to at least one suction intake device. The meshing suction profiles 28, 29 can be formed in an alternating manner transversely with respect to the transport direction X of the sheets 3.

If the rear edge of the suction profile 29 is located at the height of the front edge of the suction profile 28, the maximum length of the suction intake section 24 is reached. If the suction profiles 28, 29 are pushed into one another in a meshing manner, for example the suction profile 28 counter to the transport direction X of the sheets, the length of the suction intake section 24 is reduced.

LIST OF REFERENCE SIGNS

1 Apparatus
2 Sheet stream
3 Sheet
4 Belt
5 Cross-cutting device
6 Shaft
7 Cutting edge
8 Cutting edge
9 Transport belt
10 Shingling device
11 Raising unit
12 Deceleration unit
13 Suction belt
14 Suction box
15 Beater shaft
16 Beater
17 Braking device
18 Nip roll
19 Transport belt
20 Suction box
21 Double arrow
22 Suction profile
23 Portion
24 Suction intake section
25 Suction intake section
26 Suction profile portion
27 Suction profile portion
28 Suction profile
29 Suction profile
X Transport direction
Y Transport plane

The invention claimed is:

1. An apparatus, in particular roll-type cross-cutter, for forming a shingled stream of underlapping or overlapping sheets, in particular paper or cardboard sheets, the apparatus having:

a transport device for transporting sheets;

a shingling device for underlapping or overlapping the sheets in regions;

a braking device which is situated downstream of the shingling device in a transport direction of the sheets and which serves for braking shingled sheets, in particular by forming a braking gap for the passage of sheets that have been brought together in shingled form;

a cross-cutting device which is positioned upstream of the shingling device and which serves for cutting a material strip into individual sheets;

a first suction intake section provided upstream of the shingling device and extending between the cross-cutting device and the shingling device; and a second suction intake section provided upstream of the braking device and extending between the shingling device and the braking device and which serves for sucking up and further transporting a trailing sheet in the shingled stream into the braking device;

wherein between the first suction intake section and the second suction intake section and directly below the shingling device, a portion of a transport plane of the sheets is provided with no negative pressure or a less strong negative pressure in comparison to a negative pressure generated by the first and second suction intake sections.

2. The apparatus as claimed in claim 1, wherein a pressure level in the region of the second suction intake section is reduced less severely than in the region of the first suction intake section.

3. The apparatus as claimed in claim 1, wherein the shingling device is designed to be adjustable in and/or counter to the transport direction of the sheets in a manner dependent on a cut length.

4. The apparatus as claimed in claim 1, wherein the transport device has at least one suction belt, in particular a belt arrangement having a plurality of suction belts running parallel to one another; and wherein the at least one suction belt is guided continuously in the transport direction of the sheets over the first and second suction intake sections and the portion of the transport plane of the sheets directly below the shingling device.

5. The apparatus as claimed in claim 1, wherein at least one suction intake device is provided for forming the first suction intake section; and wherein the suction intake device has a suction profile or a suction box and/or is connected thereto.

6. The apparatus as claimed in claim 1, wherein at least one continuous suction profile is provided, in particular an arrangement of a plurality of suction profiles lying one behind another transversely with respect to the transport direction of the sheets, or a continuous suction box is provided for reducing the pressure and forming the first and second suction intake sections.

7. The apparatus as claimed in claim 6, wherein a non-continuous decrease in the reduction in pressure in the portion of the transport plane of the sheets directly below the shingling device is provided over the length of the suction profile or suction box;

wherein, preferably, the suction profile or the suction box has a lock which is movable in and/or counter to the transport direction of the sheets and serves for forming the non-continuous decrease in the reduction in pressure; and wherein, furthermore preferably, the movable lock is designed to be adjustable together with the shingling device in and/or counter to the transport direction of the sheets.

8. A method for forming a shingled stream of underlapping or overlapping sheets, in particular paper or cardboard sheets, furthermore in particular for forming a shingled stream of individual sheets cut from a material strip by means of a cross-cutting device, wherein separated sheets are transported to a shingling device and are underlapped or overlapped in regions in order to generate a shingled stream;

wherein the shingled sheets are braked by means of a braking device which is situated downstream of the shingling device in a transport direction of the sheets, in particular carried out with an apparatus as claimed in claim 1; and wherein a trailing sheets of the shingled stream is transported into the braking device under the action of intake suction.

9. An apparatus, in particular roll type cross cutter, for forming a shingled stream of underlapping or overlapping sheets, in particular paper or cardboard sheets, the apparatus having:

a transport device for transporting sheets;

a shingling device for underlapping or overlapping the sheets in regions;

a braking device which is situated downstream of the shingling device in a transport direction of the sheets and which serves for braking shingled sheets, in particular by forming a braking gap for the passage of sheets that have been brought together in shingled form;

a cross-cutting device which is positioned upstream of the shingling device and which serves for cutting a material strip into individual sheets;

a first suction intake section provided upstream of the shingling device and extending from the cross-cutting device to the shingling device; and a second suction intake section provided upstream of the braking device and extending from the shingling device to the braking device and which serves for sucking up and further transporting a trailing sheet in the shingled stream into the braking device;

wherein a magnitude of a vacuum generated in the region of the second suction intake section is less than a magnitude of a vacuum generated in the region of the first suction intake section.

10. The apparatus as claimed in claim 9, wherein the second suction intake section and the first suction intake section are interrupted directly below the shingling device.

11. The apparatus as claimed in claim 9, wherein the shingling device is designed to be adjustable in and/or counter to the transport direction of the sheets in a manner dependent on a cut length.

12. The apparatus as claimed in claim 9, wherein the transport device has at least one suction belt, in particular a belt arrangement having a plurality of suction belts running parallel to one another; and wherein the at least one suction belt is guided continuously in the transport direction of the sheets over the first and second suction intake sections and directly below the shingling device.

13. The apparatus as claimed in claim 9, wherein at least one suction intake device is provided for forming the first suction intake section; and wherein the suction intake device has a suction profile or a suction box and/or is connected thereto.

14. The apparatus as claimed in claim 9, wherein at least one continuous suction profile is provided, in particular an arrangement of a plurality of suction profiles lying one behind another transversely with respect to the transport direction of the sheets, or a continuous suction box is provided for generating the vacuum and forming the first and second suction intake sections.

15. The apparatus as claimed in claim 14, wherein a non-continuous decrease in the magnitude of the vacuum directly below the shingling device is provided over the length of the suction profile or suction box;

wherein, preferably, the suction profile or the suction box has a lock which is movable in and/or counter to the transport direction of the sheets and serves for forming the non-continuous decrease in the magnitude of the vacuum; and wherein, furthermore preferably, the movable lock is designed to be adjustable together with the shingling device in and/or counter to the transport direction of the sheets.

16. A method for forming a shingled stream of underlapping or overlapping sheets, in particular paper or cardboard sheets, furthermore in particular for forming a shingled stream of individual sheets cut from a material strip by means of a cross-cutting device, wherein separated sheets are transported to a shingling device and are underlapped or overlapped in regions in order to generate a shingled stream;

wherein the shingled sheets are braked by means of a braking device which is situated downstream of the shingling device in a transport direction of the sheets, in particular carried out with an apparatus as claimed in claim 9; and wherein a trailing sheets of the shingled stream is transported into the braking device under the action of intake suction.

17. The apparatus as claimed in claim 1, wherein at the portion of the transport plane of the sheets that is provided with no negative pressure or the less strong negative pressure, a significantly reduced suction force, if any at all, acts on a rear edge of the trailing sheet.

18. The apparatus as claimed in claim 6, wherein a non-continuous decrease in the reduction in pressure in the portion of the transport plane of the sheets directly below the shingling device is provided over the length of the suction profile or suction box.

19. The apparatus as claimed in claim 18, wherein the suction profile or the suction box has a lock which is movable in and/or counter to the transport direction of the sheets and serves for forming the non-continuous decrease in the reduction in pressure.

20. The apparatus as claimed in claim 14, wherein a non-continuous decrease in the magnitude of the vacuum directly below the shingling device is provided over the length of the suction profile or suction box.

21. The apparatus as claimed in claim 20, wherein the suction profile or the suction box has a lock which is movable in and/or counter to the transport direction of the sheets and serves for forming the non-continuous decrease in the magnitude of the vacuum.

* * * * *